United States Patent [19]

Susa et al.

[11] Patent Number: 4,568,242

[45] Date of Patent: Feb. 4, 1986

[54] COOLING FAN FOR AUTOMOBILES

[75] Inventors: Sumio Susa, Anjo; Hideaki Okamoto, Oobu; Nobuo Mitsuya, Anjo, all of Japan

[73] Assignee: Nippondenso Co., Ltd., Kariya, Japan

[21] Appl. No.: 665,091

[22] Filed: Oct. 26, 1984

Related U.S. Application Data

[63] Continuation of Ser. No. 319,280, Nov. 9, 1981, abandoned.

[30] Foreign Application Priority Data

Nov. 14, 1980 [JP] Japan ..... 55-160978

[51] Int. Cl.[4] ..... F04D 29/38

[52] U.S. Cl. ..... 415/213 C; 415/119; 416/235; 416/237

[58] Field of Search ..... 416/223 R, 169 A, 237, 416/243, 235, 240; 415/213 C, 119

[56] References Cited

U.S. PATENT DOCUMENTS

| | | | |
|---|---|---|---|
| 958,599 | 5/1910 | Cooksey | 416/240 X |
| 2,008,957 | 7/1935 | Hueglin | 416/235 |
| 2,116,054 | 5/1938 | Weichwald | 416/223 R X |
| 3,914,068 | 10/1975 | Nonnenmann . | |
| 4,180,024 | 12/1979 | Hernandez | 416/169 A X |

FOREIGN PATENT DOCUMENTS

| | | | |
|---|---|---|---|
| 2144600 | 12/1973 | Fed. Rep. of Germany | 416/223 |
| 2650433 | 12/1977 | Fed. Rep. of Germany | 416/223 A |
| 735817 | 12/1932 | France | 416/240 |
| 0535425 | 12/1954 | Italy | 416/243 |

*Primary Examiner*—Robert E. Garrett
*Assistant Examiner*—Joseph M. Pitko
*Attorney, Agent, or Firm*—Cushman, Darby & Cushman

[57] ABSTRACT

A cooling fan for automobiles which is drivable by an electric motor includes a plurality of blades, each having distal and proximal ends inclined at attachment angles larger than an attachment angle at which an intermediate portion of the blade is inclined, thereby reducing noises produced by the cooling fan.

3 Claims, 22 Drawing Figures

COOLING FAN FOR AUTOMOBILES

This is a continuation of application Ser. No. 319,280, filed Nov. 9, 1981, now abandoned.

FIELD OF THE INVENTION

The present invention relates to a fan, which can be used in a variety of applications, but is particularly useful when used as a motor-driven fan for supplying cooling air to an automobile's radiator.

BACKGROUND OF THE INVENTION

The present inventors have studied air flows caused while a fan is rotating since fan noises are generated by air flows particularly when the latter are disturbed irregularly. Upon observation of air flows during rotation of a conventional fan with the aid of a styrene particle method, it was found that no main air flow is present over a considerable area at the tip of each blade of the fan, the main air flow being defined as an air flow (indicated at U in FIG. 4) in an axial direction of the fan while the latter is rotating. An oil film method was used to observe air flows along the surfaces of fan blades. As a result, it was also found that air flows mainly in a radial direction (shown at R in FIG. 5) at the tip of each blade of the prior fan. On the basis of these experiments, the present inventors have concluded that conventional fans produce noises due to air flow distrubances at the tip of each fan blade. To confirm such conclusion, air flow disturbances during rotation of a fan were measured by a hot wire anemometer, and main air flow distribution was measured by a three-hole Pitot tube. The results of such measurements indicated that air flow is greatly disturbed and gets stalled at the blade tip. The foregoing conclusion was therefore justified.

An air flow at the tip of each fan blade is considered to be disturbed by the following reasons: As shown in FIG. 1, air is believed to flow in streams a around the blade tip 1*e* from front to rear surfaces of the blade. It is also considered that air is caused to flow from a base end portion 1*g* to the tip 1*e* of each blade 1*a* as indicated at b in FIG. 2. Where the fan 1 is used with a shroud 3 as illustrated in FIG. 3, the blade tip 1*e* traverses a boundary layer on a wall of the shroud, causing air flow disturbances at the blade tip 1*e*.

U.S. Pat. No. 3,914,068 (corresponding to West German Pat. No. 2203353) discloses a cooling fan for automobiles. The known fan has blades, each including a tip or distal end inclined at an angle greater than that at which a proximal end of the blade is inclined, an arrangement which will deliver a sufficient amount of air to an internal combustion engine even when the latter rotates at low speeds.

A fan according to the present invention is of the type driven by an electric motor at a constant output thereof. Where the prior fan having a greater blade angle at the blade tip than at the proximal end is to be driven by a motor having a constant output, the absolute value of the blade angle at the proximal end is required to be considerably small. This is because, with the greater blade angle at the blade tip, energy from the motor consumed at the blade tip is increased and energy consumed at the proximal end is reduced accordingly. It has been known that if the blade angle at the proximal end of the blade is too small, no effective work is done at the proximal end and the proximal end of the blade causes air flow to be disturbed producing noises at an increased sound pressure level. Therefore, the prior fan as a whole cannot reduce noises to a large extent since the proximal ends of the blades produce larger noises, though noises are slightly reduced at the blade tips.

SUMMARY OF THE INVENTION

The present invention has been made with the foregoing in view. It is an object of the present invention to increase the cooling efficiency of a fan without requiring an increase in the output of a motor for driving the fan, and to lower the noise level of the fan as a whole.

The above object can be achieved by having a blade angle larger at proximal and distal ends of a blade than at an intermediate portion thereof. By way of comparison with U.S. Pat. No. 3,914,068, the present invention can be characterized in that the blade angle is larger at both the proximal and distal ends of the blade than at the intermediate portion thereof, and the blade angle at the distal end may not necessarily be greater than that at the proximal end in order to achieve the foregoing object.

DETAILED DESCRIPTION OF THE PREFERRED EMBODIMENTS

Figure 4:
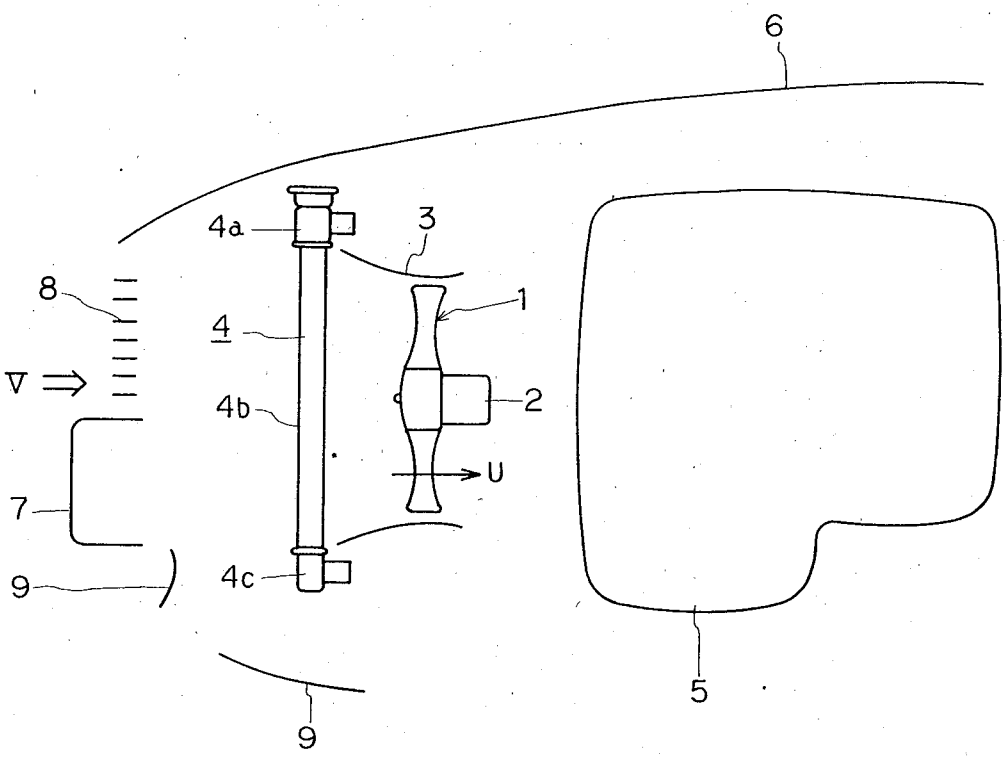
FIG. 4 is a schematic view of an automotive engine room in which a cooling fan according to the present invention is mounted.

An embodiment according to the present invention will be described. In FIG. 4, a cooling fan 1 made of synthetic resin, or a metal such as aluminum or iron is rotatively driven by a motor 2 coupled therewith to generate an air flow flowing through a radiator 4 and guided by a shroud 3. The motor 2 is attached by a stay (not shown) to the shroud 3, which is secured to brackets (not shown) of the radiator 4. The radiator 4 comprises an upper tank 4*a* for supplying coolant water from an engine 5 to a core 4*b* in which the heat of the water is radiated, and a lower tank 4*c* for delivering the cooled water from the core 4*b* to the engine 5. Designated at 6 is a hood for the automotive engine room, 7 a bumper, 8 a grille for passage of air therethrough, 9 an under plate for the engine room, and V a direction of travel of air while the automobile is running.

Figure 5:
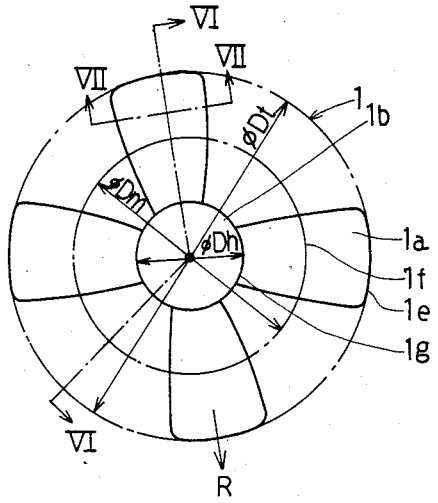
FIG. 5 is a front elevational view of the cooling fan shown in FIG. 4.
Figure 6:
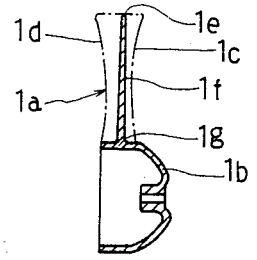
FIG. 6 is a cross-sectional view taken along line VI—VI of FIG. 5.
Figure 7:
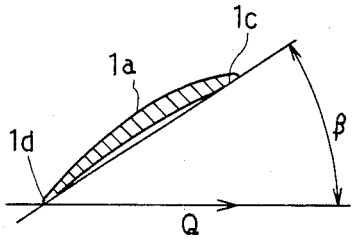
FIG. 7 is a cross-sectional view taken along line VII—VII of FIG. 5.

As shown in FIG. 5, the cooling fan 1 comprises blades 1*a* and a boss 1*b* which are formed integrally with each other as illustrated in FIG. 6. Each blade 1*a* has a cross section as shown in FIG. 7. The blade 1*a* has a leading edge 1*c* and a trailing edge 1*d* that are connected by a straight line extending at an attachment angle of $\beta$ to a direction Q of rotation of the fan 1 and hence the boss 1*b*. Since the leading edge 1*c* coincides with the trailing edge 1*d* at a tip or distal end portion ie, no such attachment angle can be determined at the tip 1*e* in the above manner. However, an attachment angle $\beta$t at the tip l*e* should be determined by plotting an attachment angle $\beta$ at any desired position in the radial direction R and by extrapolating the angle as shown in FIG. 8.

It is known that as the attachment angle $\beta$ increases, the speed of travel of main air flow also increases in a range in which the attachment angle $\beta$ is not excessively large. To obtain a higher speed of the main air flow at the tip 1*e* of the fan blade 1*a*, the attachment angle $\beta$ at the tip 1*e* is larger than that at an intermediate portion or average-diameter portion 1*f* as shown by the solid line B in FIG. 8. Designated at Dt, Dm, Dh in FIG. 8 are a diameter as taken between opposite tips 1*e*, an average diameter of the fan blades 1*a*, and a diameter as take between opposite proximal end portions 1*g* or a diameter of the boss 1*b*.

Figure 8:
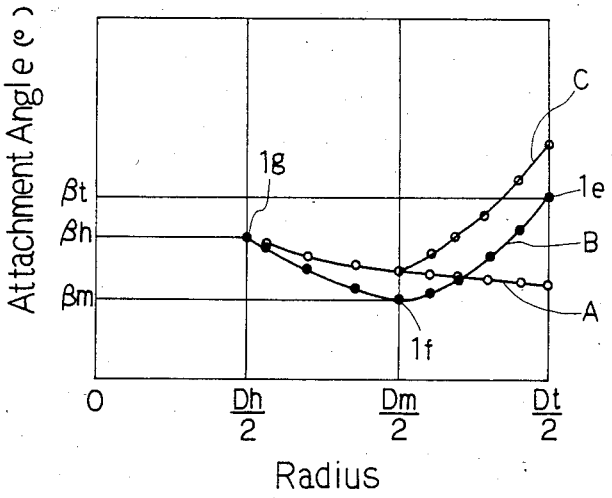
FIG. 8 is a graph indicative of angles of attachment of a blade of the fan shown in FIG. 4.
Figure 9:
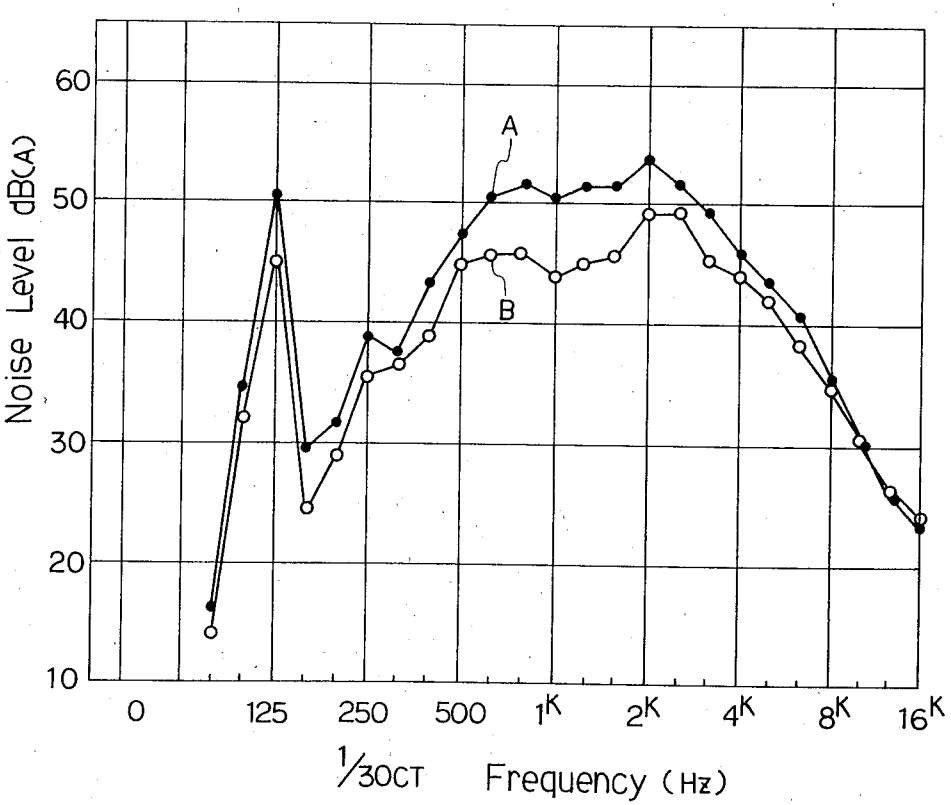
FIG. 9 is a graph indicative of degrees of noise reduction gained by the cooling fan shown in FIG. 4.

The curve indicated by the solid line A in FIG. 8 is illustrative of attachment angles $\beta$ of a blade of a conventional cooling fan. Study of the curve A indicates that the attachment angles $\beta$ of the prior fan are progressively smaller toward the tip of the blade. Upon measuring levels of noises produced by the conventional fan A and the fan B of the present invention, it has been confirmed that the fan B produces less noises in substantially the full range of frequencies as illustrated in FIG. 9. The sound pressure level around the frequency 1 KHz, which most annoys automobile passengers, is greatly reduced, and hence the fan 1 operates considerably quietly at such frequency. The fan 1 used in the experiment, the results of which are shown in FIG. 9, had four blades 1*a*, with Dt being 300 mm, Dh 90 mm, and the motor 2 had an input power of 45 Watt and rotated at 1,850 r.p.m. The fan system had an air flow resistance such that the amount of air delivered was 1,000 $m^3/h$ at a pressure of 5.4 mm Ag. The attachment angles of the fan B are as follows: $\beta h=24$ degrees, $\beta m=12$ degrees and $\beta t=28$ degrees.

The fan 1 according to the present invention should not be limited to the foregoing specifications, and may be of a variety of shapes other than that shown in FIG. 8.

Figure 10:
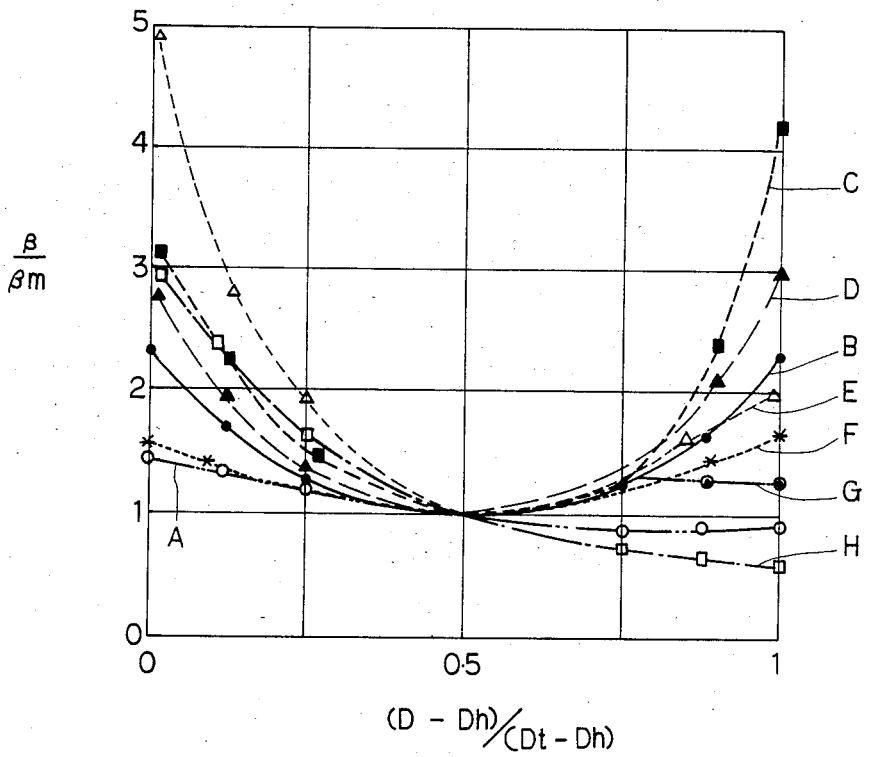
FIG. 10 is a graph indicative of ratios between attachment angles of cooling fans according to the present invention.

FIG. 10 shows curves C, D, E, F, G, which indicate ratios $\beta/\beta m$ of various fans, where $\beta$ is an attachment angle at the tip and the base of the fans and $\beta m$ is an attachment angle at the average-diameter portion, $\beta$ being larger than $\beta m$. The fan with the ratio H has an attachment angle $\beta t$ at the tip which is smaller than the attachment angle $\beta m$ at the average-diameter portion. THe fan with the ratio G has a constant attachment angle $\beta$ at the tip, with the ratio $\beta/\beta m$ from the intersection of the curves F and G to the base being equal to that of the curve F. As can be seen from FIG. 10, the attachment angles at the tip of the fans E and G are smaller than those at the base of these fans. As described below, it has been confirmed that the fans C, D, E, F, G have lower noise levels than those of the prior fan A and the fan H having the smaller attachment angle $\beta t$ at the tip 1*e* than that of the prior fan A.

Figure 11:
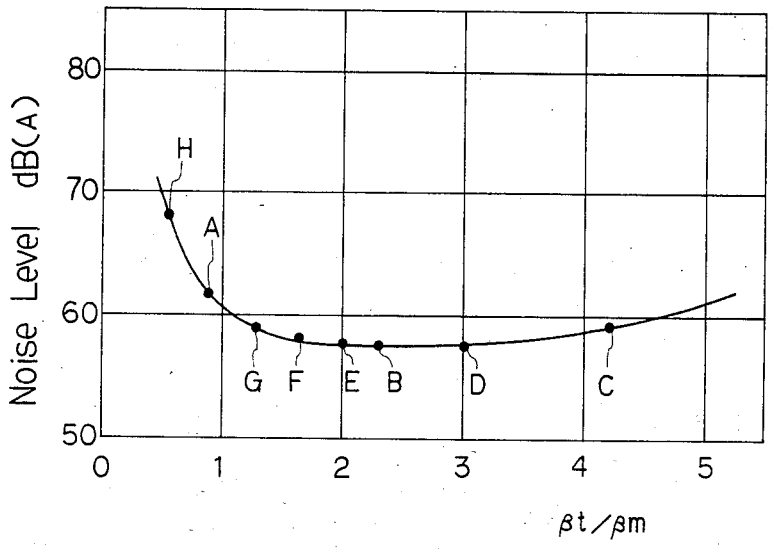
FIG. 11 is a graph indicative of degrees of noise reduction attained by the cooling fans described with reference to FIG. 10.

FIG. 11 illustrates noise levels of the fans A, B, C, D, E, F, G, and H plotted against the ratio $\beta t/\beta m$ between the attachment angle $\beta m$ at the average-diameter portion 1*f* and the attachment angle $\beta t$ at the tip 1*e*. Study of the graph of FIG. 11 clearly indicates that the fans B, C, D, E, F, and G with the ratio $\beta t/\beta m$ greater than 1 produce less noises. Where the ratio $\beta t/\beta m$ is too large, that is, where the attachment angle $\beta t$ at the tip 1*e* is excessively large, the air flow at the tip 1*e* of the fan blade is subjected to separation and becomes disturbed, resulting in a higher noise level. For that reason, the ratio $\beta t/\beta m$ should preferably be 5 or below.

To confirm the experimental results shown in FIG. 11, the present inventors measured air flow disturbances for the fans A, B, C, D, E, F, G, and H with a hot wire anemometer, and also measured air speed distribution for the main air flow with a three-hole Pipot tube. The results of such measurements showed that with the fans B, D, E, and F, that is, with the ratio $\beta t/\beta m$ in the range of from 1.5 to 3.5, the air flow disturbance at the fan blade tip 1*e* is held to a minimum and the speed of the main air flow is maximum, while the fan C with the greater rario $\beta t/\beta m$ is subjected to increased air flow disturbances at the blade tip 1*e*, which have once been reduced.

The fans A, B, C, D, E, F, G, and H have different attachment angles $\beta h$ at the proximal end portion 1*g* than the attachment angles $\beta m$ at the average-diameter portion 1*f*. However, measurement of air flow disturbances with a hot wire anemometer indicated that the ratio $\beta h/\beta m$ does not greatly affect air flow disturbances. It has been recognized though that as the attachment angle $\beta h$ at the base portion 1*g* is increased, i.e., as the ratio $\beta h/\beta m$ is increased, the air flow disturbances are gradually reduced, and where the attachment angle $\beta h$ is too small, the fan blade 1*a* does not perform effective work, resulting in a disturbed air flow and hence an increased sound pressure level. The ratio $\beta h/\beta m$ should preferably be 1.4 or greater.

Figure 12:
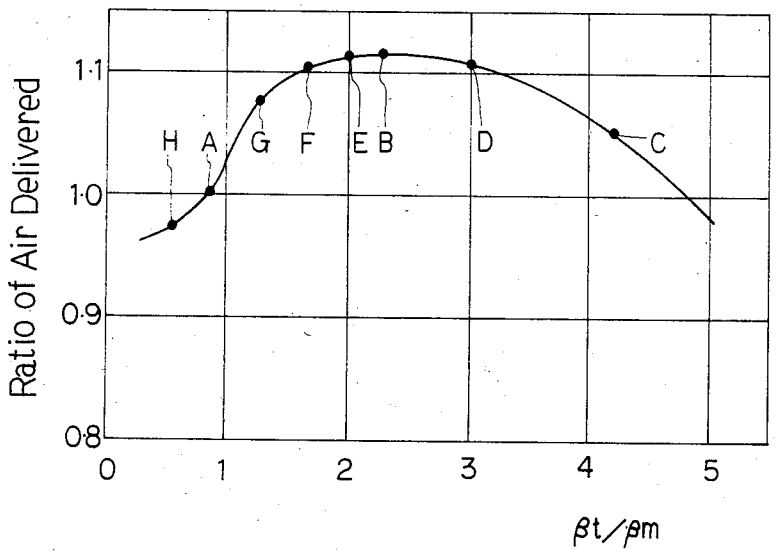
FIG. 12 is a graph indicative of ratios of amounts of air supplied by the cooling fans described with reference to FIG. 10 to an amount of air supplied by a conventional cooling fan.

A fan having a reduced noise level would be unacceptable if the noise level reduction were accompanied by a reduction in the amount of air delivered by the fan. The present inventors therefore studied the effects which the ratio $\beta t/\beta m$ has on the amount of air delivered. FIG. 12 shows the results of measurements for determining such effects. A review of FIG. 12 shows that the fans B, C, D, E, F, and G with the ratios $\beta t/\beta m$ being 1 or more deliver a greater amount of air than that delivered by the conventional fan A. The vertical axis of the graph of FIG. 12 is indicative of ratios of the amounts of air delivered by the fans of the present invention to the amount of air supplied by the conventional fan A.

The reasons why the fans B, C, D, E, F, and G of the invention deliver increased amounts of air as shown in FIG. 12 are considered as follows: Whereas no effective main air flow is generated at the blade tip 1*e* of the prior fan A, the fans B through G with the attachment angles being larger according to the invention permit an effective main air flow to be generated at their blade tip 1*e*, and prevent disturbed air flows from being produced at their base portions by having larger attachment angles at the base portions than at the average-diameter portions.

The experiments illustrated in FIGS. 11 and 12 are based on comparison between fans having the same size and driven by a motor 2 with a constant output. With the fans having the ratio $\beta t/\beta m$ of 1 or higher, the amount of work done by the tip of each blade is increased by a reduction in the amount of work done by the average-diameter portion, resulting in a constant amount of work done bodily by the fans. Therefore, the attachment angle at the average-diameter portion of the fans according to the invention is smaller than that of the conventional fan as illustrated in FIG. 8. Even with the amount of work done by the average-diameter portion being reduced, no substantial reduction in the main air flow (Volume of air) is caused as the air flow around the average-diameter portion is stable. As a consequence, an increase in the main air flow at the blade tip makes up for the reduction in the main air flow at the average-diameter portion and results in an overall increase in the main air flow across the fans. As described above, the fan with attachment angles from the average-diameter portion 1*f* to the tip 1*e* being varied according to the curve C in FIG. 8 is required to be driven by a motor capable of producing an output greater than that produced by a motor for driving the fan A.

Figure 13:
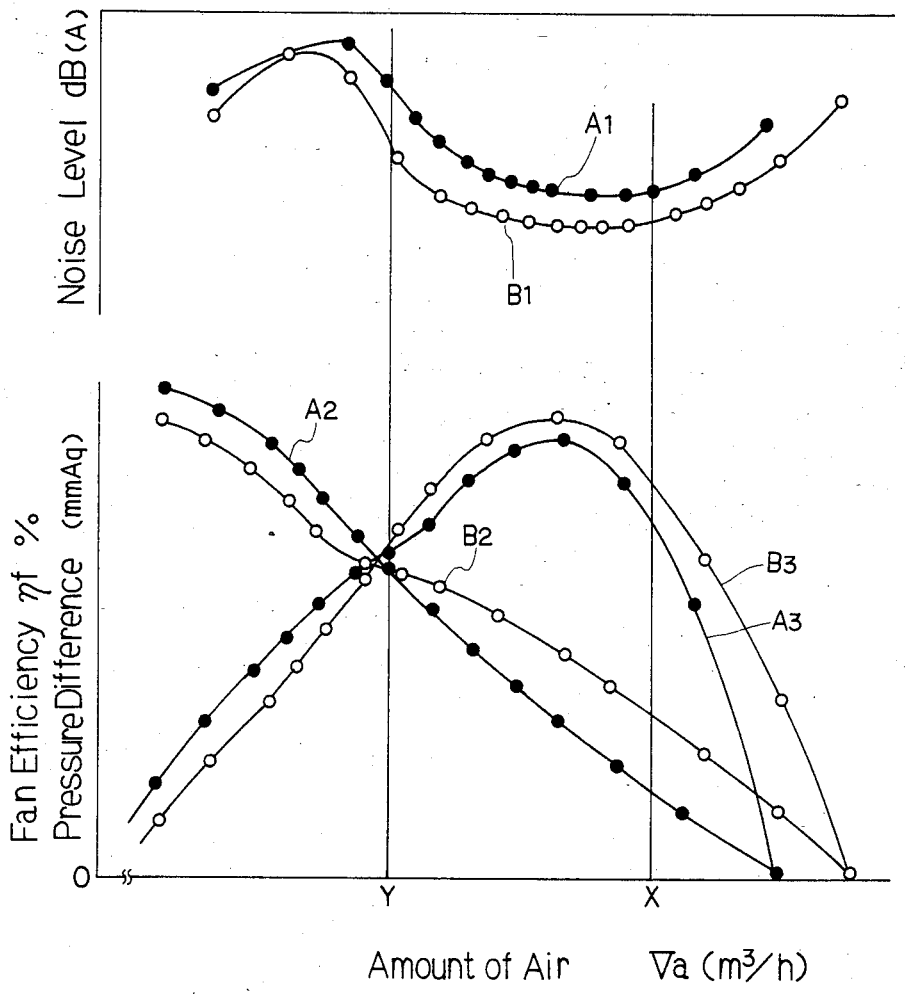
FIG. 13 is a graph showing various performances of the cooling fan shown in FIG. 4 as incorporated in an automotive radiator.

The fans according to the present invention are particularly useful when used for cooling automotive radiators. Such usefulness of the fans of the invention will be described below with reference to FIG. 13, which shows noise levels (shown by the curves $A_1$, $B_1$), static pressures or differential pressures between the front and rear of the fans (shown by the curves $A_2$, $B_2$), and efficiencies of the fans (shown by the curves $A_3$, $B_3$) plotted against amounts of air delivered with respect to the fan B of the present invention and the prior fan 4 as simulatively installed in the engine room as illustrated in FIG. 4. Comparison between the curves $A_1$, $B_1$ indicative of the noise level shows that the noise level (curve $B_1$) of the fan of the invention is lower than the noise level (curve $A_1$) of the conventional fan. Comparison between the curves indicative of the static pressure characteristics and fan efficiencies indicates that the static pressure (curve $B_2$) and the efficiency (curve $B_3$) of the fan according to the present invention are greater than those of the prior fan in the region in which the amount of air delivered is greater than the point Y. It is preferable that the point Y corresponds to the idling mode of operation of the automobile, and the point, for example X, at which the fan efficiency is greater than that at the point Y, corresponds to the running mode of operation of the automobile which requires maximum cooling of the engine. With such an arrangement, the noise level at the point Y for the idling of the automobile is greatly reduced as can be seen from comparison between the curves $A_1$ and $B_1$. The engine is subjected to the maximum degree of cooling at the point X near the maximum fan efficiency. Accordingly, the noise is reduced while the automobile is at rest with the engine idling, a feature which is advantageous since large noises produced during engine idling would be annoying. The fan according to the present invention is especially useful as a cooling fan for automotive radiators.

While the present invention has been described as being applied to one preferred form, the invention is applicable to a variety of modified forms.

Figure 14:
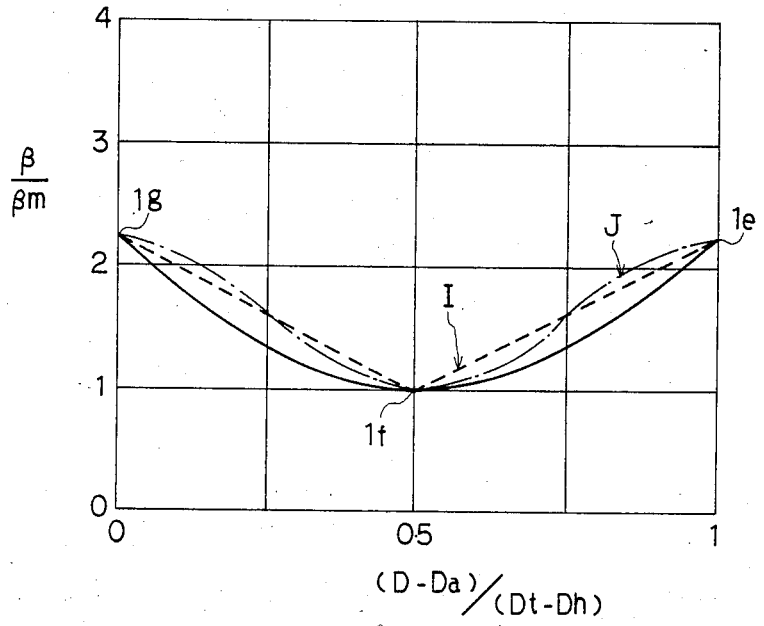
FIGS. 14 and 15 are graphs indicative of other ratios between attachment angles of cooling fan blades.
Figure 15:
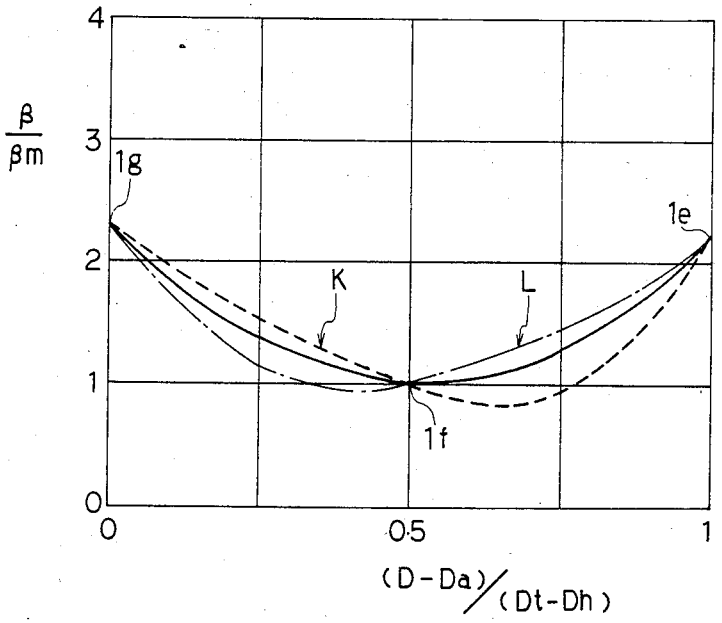

Provided that the attachment angle $\beta t$ at the blade tip 1*e* is larger than the attachment angle $\beta m$ at the average-diameter portion 1*f*, the attachment angle $\beta$ therebetween may be varied rectilinearly as shown at I in FIG. 14 or may be varied along a curve of a multiple degree. The attachment $\beta$ may not be minimum at the average-diameter portion 1*f*, but may become minimum at a position displaced from the average-diameter portion 1*f* a little toward the tip 1*e* or the base 1*g* as shown by the curve K or L in FIG. 15.

Figure 16:
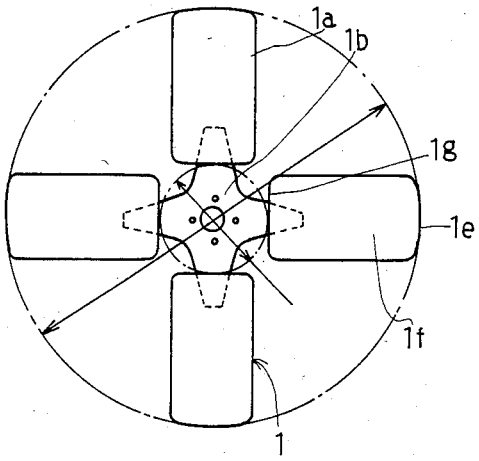
FIGS. 16 and 17 are front elevational views of cooling fans according to other embodiments.
Figure 17:
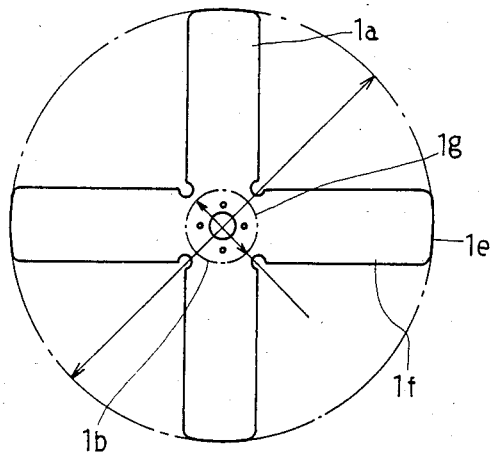

While in the foregoing embodiment the blades 1*a* are integral with the boss 1*b*, the blades 1*a* may be in the form of iron sheets and separate from the boss 1*b* as illustrated in FIGS. 16 and 17, in which case the blades 1*a* and the boss 1*b* are connected together by revetting or spot-welding. The diameter (of the boss) Dh between opposite blade base portions should be determined as shown.

Figure 1:
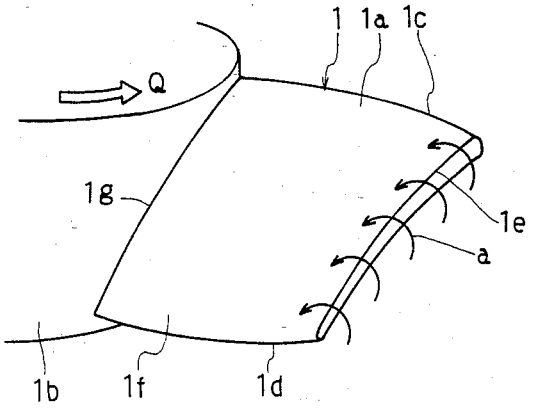
FIGS. 1 through 3 are views illustrative of streams of air at the tip of a blade of a cooling fan.
Figure 2:
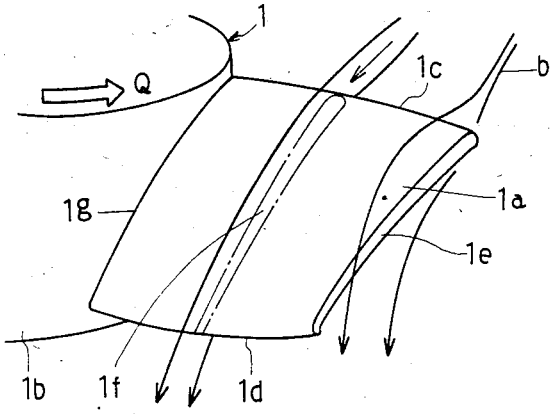
Figure 3:
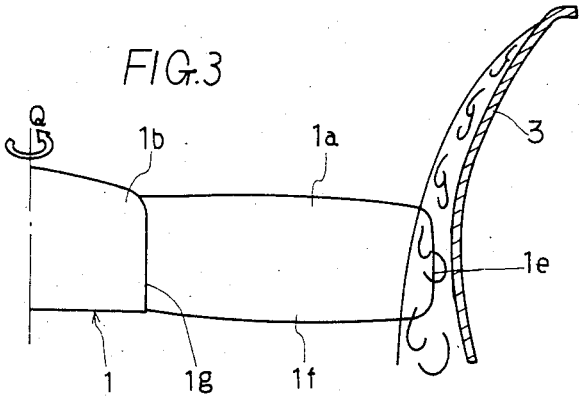
Figure 18:
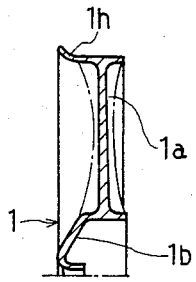
FIG. 18 is a fragmentary cross-sectional view of a cooling fan according to still another embodiments.
Figure 19:
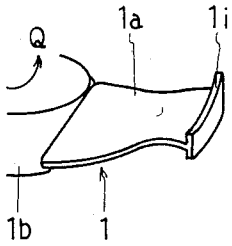
FIGS. 19 and 20 are fragmentary perspective views of cooling fans in accordance with other embodiments.
Figure 20:
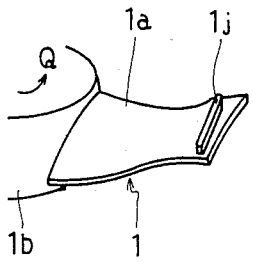

The fan 1 thus constructed may include members for preventing air from flowing in streams around the blade tip 1*e* shown at a in FIG. 1. FIG. 18 shows a ring 1*h* on the blade tip 1*e* for preventing such air streams. The blade tip 1*e* shown in FIG. 19 has a wall 1*i* for preventing air from flowing around the blade tip 1*e*. As shown in FIG. 20, a wall 1*j* for preventing air streams from flowing around the blade tip may be mounted on one side of the blade 1*a*.

Figure 21:
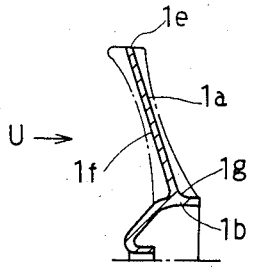
FIG. 21 is a fragmentary cross-sectional view of a cooling fan according to still another embodiment.
Figure 22:
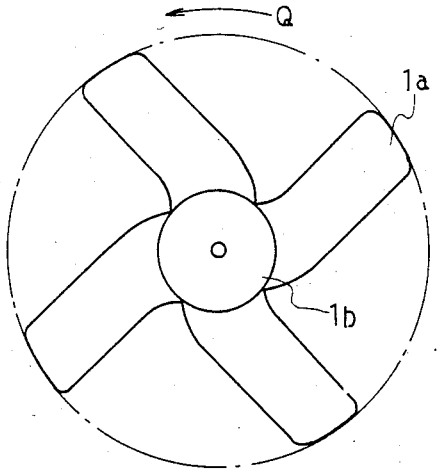
FIG. 22 is a front elevational view of a cooling fan according to still another embodiment.

While the blade 1*a* extends perpendicularly from the boss 1*b* as shown in FIG. 6, the blade 1*a* may be inclined in a forward direction as shown in FIG. 21 or may be included in a rearward direction. With the blade 1*a* thus inclined, an air flow toward the blade tip 1*e* is improved. To further improve such an air flow toward the blade tip 1*e*, the blades 1*a* may be swept forward in the direction of rotation of the fan as shown in FIG. 22, or may be swept backward in the direction of rotation of the fan. The present invention is applicable to stationary blades when incorporated in a fan equipped with such stationary blades.

Although in the embodiment shown in FIG. 4 the fan 1 is located rearward of the radiator 4 to draw air through the latter, the fan 1 may be disposed in front of the radiator 4 to blow air into the latter. The fan 1 according to the present invention should not be limited to use for cooling radiators, but is applicable in a wide variety of fans and blowers.

With the arrangement of the present invention, the fan has an attachment angle that is greater at a blade tip than at an average-diameter position to cause a large main air flow to be produced at the blade tip, thus reducing air flow disturbances at the blade tip and hence reducing noises due to such air flow disturbances.

What we claim is:

1. In an automobile having a radiator, a shroud adjacent to said radiator, and a fan rotatably supported within an area surrounded by said shroud, said fan comprising:

a boss; and a plurality of relatively rigid blades, each connected to said boss and extending therefrom radially outwardly, the cross-sectional configuration of each blade being substantially analogous over its entire radial length, and the attachment angles of each of said blades at its distal and proximal ends being larger than that at an average-diameter portion of said blade, the attachment angle of said proximal end being at least 1.4 times larger than that of said average diameter portion.

2. In a cooling fan according to claim 1, said attachment angle at said distal end is larger than that at said average-diameter portion by less than five times.

3. In a cooling fan according to claim 1, said attachment angle at said distal end is 1.5 to 3.5 times larger than that at said average-diameter portion.

* * * * *